United States Patent [19]

McFarland

[11] Patent Number: 4,611,523

[45] Date of Patent: Sep. 16, 1986

[54] DEVICE FOR SETTING THE INTONATION OF THE INDIVIDUAL STRINGS OF A FRETTED STRING INSTRUMENT

[76] Inventor: John H. McFarland, 1101 N. Paulina St., Chicago, Ill. 60622

[21] Appl. No.: 735,139

[22] Filed: May 17, 1985

[51] Int. Cl.[4] ..... G10D 3/00

[52] U.S. Cl. ..... 84/313; 84/298; 84/312 R

[58] Field of Search ..... 84/298, 299, 313, 312 R

[56] References Cited

U.S. PATENT DOCUMENTS

| | | | |
|---|---|---|---|
| 490,528 | 1/1893 | Wooster | 84/298 |
| 2,491,788 | 12/1949 | Widowson | 84/299 |
| 2,740,313 | 4/1956 | McCarty | 84/307 |
| 2,741,146 | 4/1956 | Fender | 84/313 |
| 2,972,923 | 2/1961 | Fender | 84/313 |
| 3,466,962 | 9/1969 | Cole | 84/313 X |
| 4,497,236 | 2/1985 | Rose | 84/298 |

*Primary Examiner*—Benjamin R. Fuller

*Attorney, Agent, or Firm*—Mann, McWilliams, Zummer and Sweeney

[57] ABSTRACT

A device for setting the intonation of the individual strings of a fretted stringed instrument, such as a guitar, wherein the instrument bridge includes for each of the individual strings both an end restraining and a fine tuning apparatus, for instance, of the type disclosed in Rose U.S. Pat. No. 4,497,236; the intonation setting device comprises a tool that includes a first rigid carriage member formed at one end to seat against the bridge rear end on either side of the fine tuning screw of the string to be set by the tool, and formed at its projecting end with a flange that journals an adjustment screw, and a second rigid follower member slidably mounted within the first rigid member intermediate the ends of the latter, and having a foot that seats against the head of the string clamp screw, and a flange that is threadedly enaged by the adjustment screw, whereby when the tool first and second rigid members are seated as indicated, the adjustment screw actuated to adjust the tool members into firm contact with the bridge parts they seat against, and the string tensioning apparatus anchor screw is released for adjusting such apparatus longitudinally of the bridge, the tool is actuated to set the intonation of the string, after which the string anchor screw is retightened and the tool removed and applied to the next string of the instrument that requires the same adjustment.

8 Claims, 6 Drawing Figures

DEVICE FOR SETTING THE INTONATION OF THE INDIVIDUAL STRINGS OF A FRETTED STRING INSTRUMENT

This invention relates to a device for facilitating the setting of the intonation of the individual strings of a fretted stringed instrument, such as a guitar, which instrument is arranged so that the individual strings thereof each have a combination of an end restraining and a fine tuning apparatus of the type disclosed in Rose U.S. Pat. No. 4,497,236 (the disclosure of which is hereby incorporated herein by this reference). More specifically, the invention is concerned with a tool that is adapted for application to guitars and other fretted stringed instruments where the bridge may be of the Floyd Rose brand locking tremolo type equipped with fine tuners for each of the strings.

It is well known in the art of stringing guitars that individual string clamping devices incorporated at the bridge and nut of the instrument greatly increase the length of time the instrument will remain pitch tuned. Pitch tuning is accomplished by increasing or decreasing the tension on a given string, thereby raising or lowering, respectively, the pitch of the string.

It is also common practice to include such string clamping devices on tremolo bridge arrangements, an example of which is disclosed in said Rose patent, which also discloses an arrangement for each of the strings whereby the strings can be fine tuned while the individual strings remain clamped.

It is also known that in the techniques of stringing guitars, much attention has been given in the past to improving the adjustability of string length relative to the alignment of the first harmonic of that string to the twelfth fret on the fingerboard of the guitar. This adjustment is commonly known as "setting the intonation", and is necessary to insure the proper noting of the string when fretted by the player. It has been established in this field that a guitar bridge device which permits adjustment of the string while the string remains in tension provides for a more rapid and accurate setting of the individual guitar strings. A special criteria for this type of device is that the ease of manipulation of the adjustment mechanisms involved is highly important since the guitar player often finds it necessary to set the intonation of a new string while on the job.

String clamping and fine tuning apparatus of the type disclosed in said Rose patent includes a base plate appropriately secured to the guitar body to form the bridge of the guitar, which may be of either the regular bridge type fixed to the guitar body in some conventional manner, or of the locking tremolo type. The bridge includes, for each guitar sring, a string end clamping and fine tuning assembly. Each such assembly includes a forward block or body and a rear block or body with the latter being pivotally connected to the forward block or body. The string to be associated with the assembly in question makes critical contact with the clamping and fine tuning apparatus for that string at a critical point on the rear block or body and maintains surface contact with the rear block or both as the surface thereof slopes downwardly and rearwardly from the bridge critical contact point to the location where the string is clamped against the rear block or body abutment surface by a clamp element associated with the rear block or body through which a threaded adjustment shank is threaded and extends rearwardly of the assembly for clamping the clamping block against the string. The bridge, for each string, includes a fine tuning screw that is rearwardly of the string end clamp and fine tuning apparatus indicated, and is disposed normally of the string clamping adjustment screw shank, with the arrangement of the parts being such that by adjusting the position of the fine tuning adjustment screw against the shank of the string clamping threaded member, the rear block or body is pivoted relative to the front block or body to result in the change in the tension of the string and hence fine tuning of the string.

While string clamping and fine tuning devices of the type disclosed in said patent are very useful to the musician using the instrument, they do not provide any way of adjusting the individual strings to the proper position for intonation while maintaining adequate tension on the string, so as to compare and align the string first harmonic and the instrument twelfth fret, and especially insofar as guitars are concerned.

A principal object of the present invention is to provice a device or tool that is applicable to the individual string clamping and fine tuning apparatus for each string, of the type disclosed in said Rose patent, to readily permit setting of the string intonation while maintaining full bridge clamping action on the string as well as adequate tension.

Another principal object of the invention is to provide a tool for individually setting the intonation of each of the instrument strings, which permits the musician to readily and easily set the intonation of one or more strings of his guitar even when a new string has to be so set while the musician is on the job.

Another important objective of the invention is to provide a guitar string intonation setting tool or device of few and simple parts, that can readily be applied and used to guitar bridges of the type indicated, even by musicians who are relatively inexperienced in the use of mechanical devices.

A further important object of the invention is to provide a guitar string intonation setting device for application to the guitar bridge that is simple and easy to operate, and yet completely safe in spite of the high tension forces that act on the guitar strings.

In accordance with the invention, a device in the form of a tool for setting the intonation of guitar strings and the like is provided comprising a first elongate rigid carriage or carrier member that has one end of same shaped for firm seating against the bridge flange, for the string that is to have its intonation set, in substantially parallel relation to the shank of the string clamping and fine tuning apparatus, with the indicated carriage member projecting rearwardly of the bridge and at its rearwardly projecting end defining an upstanding flange which journals the threaded actuating member having a rearwardly disposed hand knob, and a second rigid member in the nature of a follower element that is mounted on the carriage member for shifting movement longitudinally of the latter, and defines an upstanding flange that is threadedly engaged with the tool threaded actuation member, with the follower member including a depending flange portion adapted to seat against the head of the string clamping adjustment screw. A helical compression spring is applied about the tool actuation member between the carriage journaling flange therefor and the upstanding flange of the follower member to bias the follower member in the direction of its said one end.

When the tool is adjusted to make firm contact between the bridge and clamping screw of the string being set, the string clamping and fine tuning apparatus forward end rearward blocks or bodies, for the string in question, are released, with the tool then carrying and maintaining the longitudinal tension in the string, and the tool being further adjusted by turning the screw member hand knob to adjust the string length to the proper position required for setting of the string intonation, after which the string clamping and fine tuning apparatus forward and rearward blocks are reclamped in place, and the tool is loosened for application other similar string assemblies, of the bridge, needing this adjustment.

Other objects, uses, and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
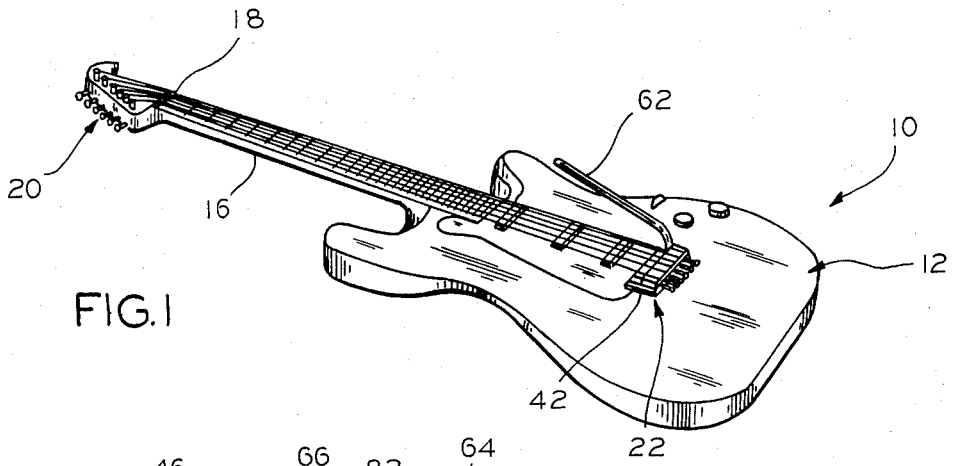
FIG. 1 is a diagrammatic view showing as an example the string clamping and fine tuning apparatus of said patent as applied to an electric guitar tremolo apparatus.

Reference numeral 10 of FIG. 1 indicates a diagrammatically illustrated guitar having the usual body 12 and neck 16. Near the top of the neck 16 is the usual nut element 18 beyond which are the usual turning pegs generally indicated by reference numeral 20, one such turning peg for each guitar string of the guitar. Applied to the body 12 of the guitar is the bridge device 22, which is of the locking tremolo type disclosed in said Rose patent and includes a clamping and fine tuning apparatus 70 for each string, of which there are six such apparatus 70 as a six string guitar is illustrated, which will thus have strings 24, 26, 28, 30, 32, and 34 (shown in foreshortened form in FIG. 2) that are tuned in the manner characteristic of guitars. The guitar strings of the guitar 10 are pitch or fine tuned by changing the tension on the respective strings. This should be done ideally without changing the distance between the nut 18 and the bridge vertical contact point which is the bridge string contact point nearest the nut 18 for the respective strings. Increasing the tension of the string raises the pitch of the string, while decreasing the strings tension lowers the string pitch. The string bridge clamping and fine tuning apparatus 70 illustrated for each string (which is that shown in said Rose patent), provides for changing of the tension of the individual strings essentially without changing the distance between the critical string contact points at the nut 18 and bridge 22.

Guitar strings are also harmonically tuned, with the harmonic tune of the strings being changed by changing the distance between the last contact point of the string on the nut 18 and the first string contact point on the bridge. These contact points may be referred to as the critical contact points of the instruments strings. Harmonic tuning may be accomplished, for example, by moving the bridge or the critical contact point of a string on the bridge longitudinally relative to the nut 18.

In the illustrated guitar 10, the bridge arrangement is of the tremolo type in the operation of which the bridge is tilted relative to the body 12 of the guitar to momentarily significantly change the pitch of the guitar strings, as is well known in the art.

Figure 2:
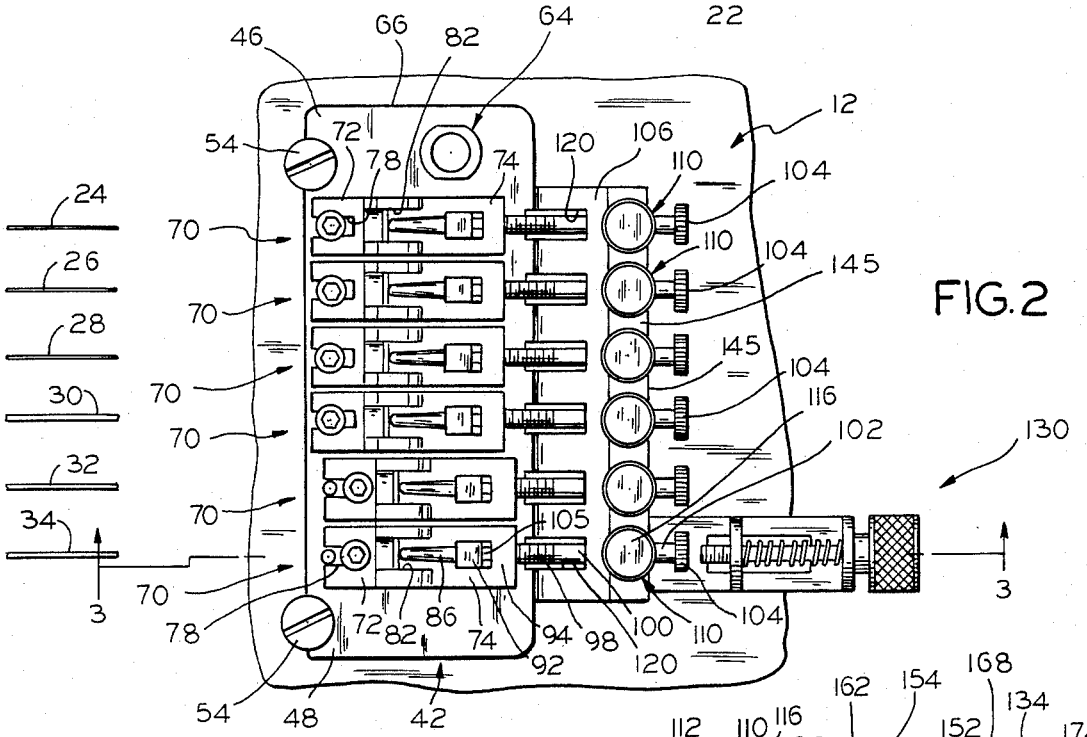
FIG. 2 is a diagrammatic view of the bridge and its adjacent guitar body parts shown in FIG. 1, with the strings broken away short of the bridge (to avoid a confusion of lines at the bridge), and one embodiment of the tool of the present invention shown applied in operative relation to the low E string of the guitar.
Figure 3:
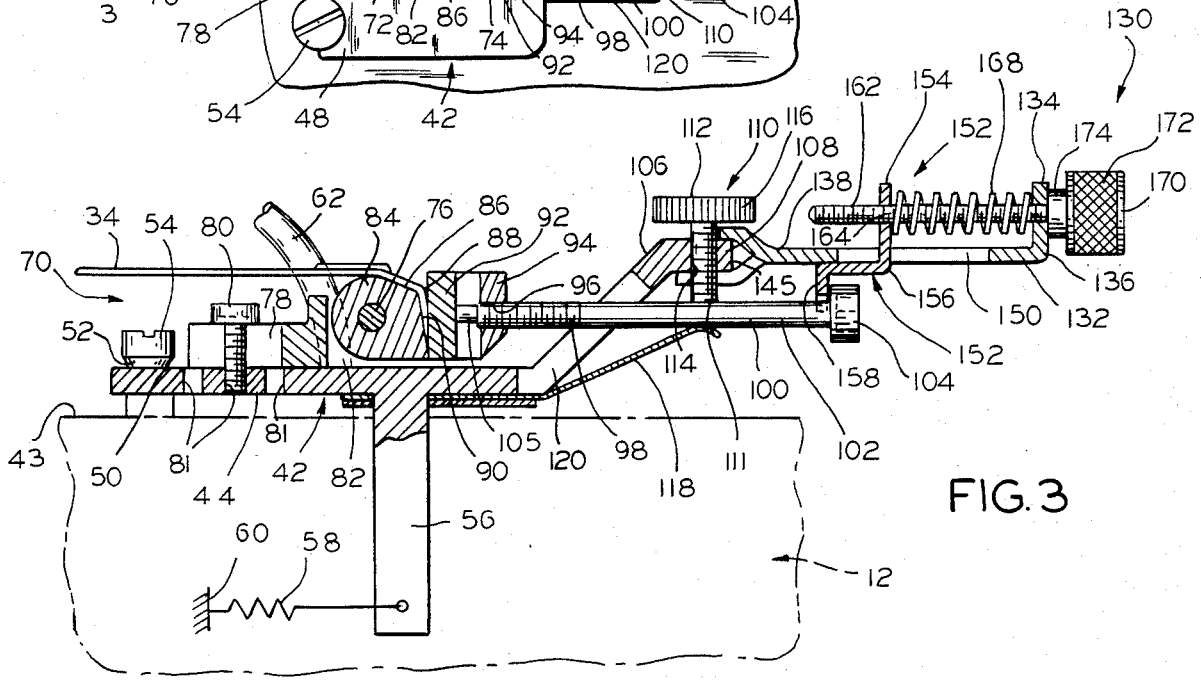
FIG. 3 is a diagrammatic cross-sectional view taken substantially along line 3—3 of FIG. 2, with some parts shown in elevation, including the string end that is clamped at this bridge position.

The bridge arrangement 22 that is diagrammatically illustrated in FIGS. 2 and 3 includes a tremolo base plate 42, a primary part of which is the planar plate portion 44 which is generally aligned parallel to the top surface 43 of the guitar body 12 and includes at each of its forward corners 46 and 48 a familiar knife edging section 50 (see FIG. 3) that engage with the usual tapered grooves 52 of position screws 54 which are fixed to the body 12 of the guitar. At the rear of the base plate 42 depending flange 56 is provided which extends downwardly into the usual cavity in the body of the guitar, and is spring biased by a conventional spring or springs 58 acting between the flange 56 and a suitable anchor 60 within the guitar body.

The bridge arrangement 22 includes a tremolo bar 62 that is suitably and conventionally secured to bridge base plate 42, where indicated at 64 in FIG. 2, adjacent one of the longitudinal edges 66 of the base plate 42. When the tremolo bar 62 is moved toward the body 12 of the guitar, the tremolo base plate 42 is tilted upwardly against the action of the spring or springs 58 about the two fixed position screws 54. This action significantly changes the original pitch tune of the instrument and facilitates an increased range of sounds for the instrument, as is well known in the art. When the original pitch tune is again desired, the tremolo bar 62 is released and the spring or springs 58 return the tremolo base plate 42 to its original position, which returns the bridge arrangement 22 and the strings to their original positions indicated in FIG. 3.

However, it should be understood that even though the present invention is illustrated and described in connection with a tremolo device, the invention is also applicable to bridge plate arrangements in which the bridge is fixed to the body of the guitar.

The bridge arrangement 22 is also shown to be provided with a string clamping and fine tuning assembly or apparatus 70 for each string of the guitar, of the type disclosed in said Rose patent. Each of the assemblies 70 comprises a forward block or body 72 and a rear block or body 74 which is pivotally connected to the forward block or body 72 by suitable cross pin 76 (see FIG. 3). The forward block or body 72 of each assembly 70 is slotted as at 78 for application of a clamping screw 80 through the slot 78 to a selected threaded screw hole 81 in base plate 42 (the hole 81 selected will give a selected harmonic tuning of the string it services) to clamp or lock the assembly 70, of which the forward body or block 72 forms a part, to the bridge base plate 42. The forward body or block 72 is also vertically grooved in the rear portion of same, as at 82 to, receive the tongue 84 of the rear block or body 74 that is pivotally connected to the forward block or body 72 by cross pin 76. The block or body 74 is shaped along its tongue 84 to provide the support back up for groove 86 that receives the string end 88, as well as abutment surfacing 90 against which the string end 88 is pressed by clamping block or body 92. The rear block or body 74 includes a cross wall portion 94 formed with a threaded aperture 96 that threadedly receives the threaded portion 98 of shank 100 of clamp screw 102, which includes the usual screw head 104 and clamping stud end 105 that bears against the clamping block 92. The relation of the clamping screw 102 to the cross wall portion 94 and clamping block 92 results in the screw 102 serving as a lever for fine tuning of the string whose end 88 is clamped by same, and for this purpose the bridge base plate 42 is provided with an upwardly and rearwardly directed extension 106 that terminates in a rearwardly directed flange 108 to which is threadedly applied fine tuning adjustment screw 110 comprising a threaded shank 112 threadedly received in threaded aperture 114 of the flange 108 and engaging the clamping screw shank 100 at end 111 (of shank 112) and having a knurlled head 116 at the other end of same. Suitable leaf spring type retaining spring arm 118 is suitably and conventionally affixed to the other side of bridge base plate 42 to bias the shank 100 of the clamping screw 102 against the end 111 of fine tuning screw 110.

As indicated, the bridge arrangement 22 has a spring end clamping and fine tuning apparatus 70 for each of the strings of the guitar, as indicated in FIG. 2, with the respective clamping screws 102 extending through individual slots 120 formed in the bridge plate extension 106 at the position of each of the guitar strings, with the fine tuning screws 110 being aligned with and in normal relation to the end threaded portion of the shanks 100 of the respective screws 102, and with the respective spring arms 118 (not shown in said Rose patent) bearing against the respective clamping screws 102.

As disclosed in said Rose patent, the shanks 100 of the screws 102 and the rear block or body 74 or each individual apparatus 70 are free to move a short distance toward and away from the guitar body because of the extension of the respective screw shanks 102 through the respective slots 120 formed in the bridge plate extension 106, and the pivotal connection of the rear block or body 74 to the front block or body 72. The threaded shank 100 of clamp screw 102 is biased against the end 111 of the fine tuning screw 110 both by the action of the tension of the instrument string that is clamped by a particular mechanism 70, and the biasing action of the spring arms 118 shown in FIG. 3. The position of the clamp screw shank 100 and thus the rotational or pivot position of the block element 92 is determined by the position of the fine tuning adjustment screw 110 relative to the bridge plate flange 108; the screw 110 of each assembly 70 may be conveniently rotated either by hand or a conventional screw driver, and threading of the screw 110 downwardly of FIG. 3 pushes the threaded shank 100 downwardly of FIG. 3 and rotates the rear block or body 74 clockwise of FIG. 3 to increase the tension on the string having its end 88 clamped by an assembly 70. Threading the screw 110 in the opposite direction results in upward movement of the screw shank 100 and a counterclockwise rotation of the block 92 (in the showning of FIG. 3 to reduce tension on the string). Thus, for a particular assembly 70 of FIGS. 2 and 3, if the tension on a given string is to be changed, that is fine tuned, the adjustment screw 110 is rotated to move it downwardly of FIG. 3 to increase the string tension, and thus increase the string pitch, with rotational movement of the screw 110 in the opposite direction decreasing the string tension and hence reducing the string pitch.

While the individual assemblies 70 provide for adequate tensioning and fine tuning of the individual guitar strings, the bridge arrangement 22 does not permit adjusting the bridge for proper positioning for intonating the individual strings, while maintaining adequate tension on the respective strings, so as to prepare and align the first haromic of the respective springs and the twelfth fret of the guitar.

Figure 4:
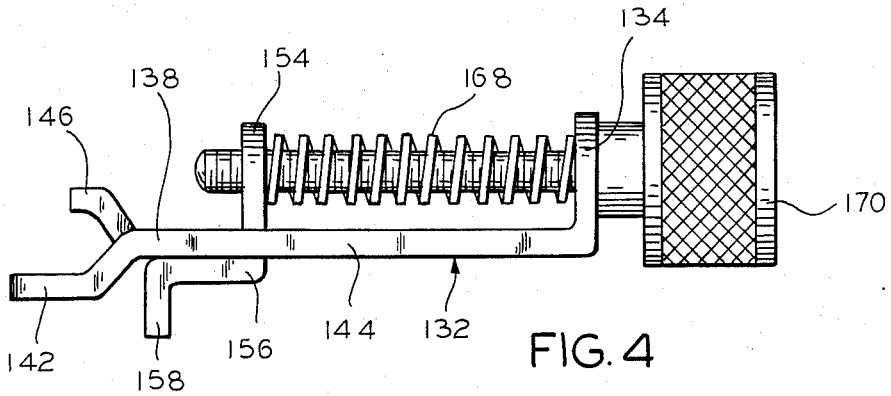
FIG. 4 is a side elevational view of the string intonation setting device or tool shown in FIGS. 2 and 3.
Figure 5:
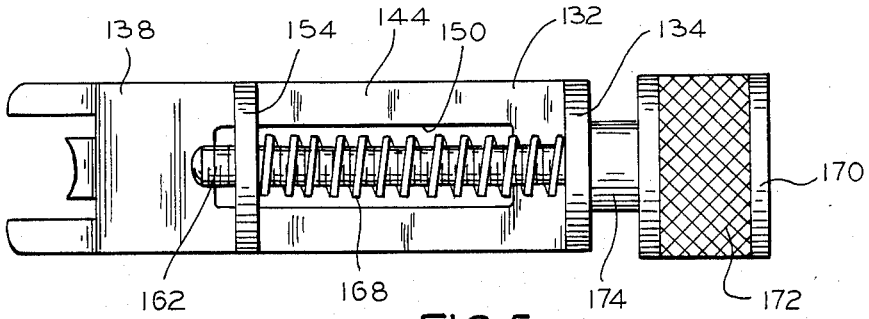
FIG. 5 is a top plan view of the tool or device shown in FIG. 4.
Figure 6:
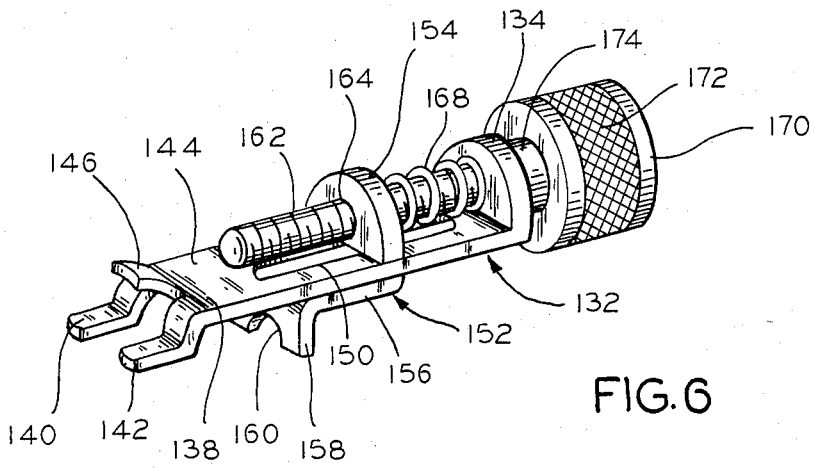
FIG. 6 is a diagrammatic perspective view of the tool or device of FIGS. 2–5.

For serving this function, the Applicant provides tool 130 that is shown in FIG. 2 applied to the lower E string of the guitar 10 in FIGS. 2 and 3, and that is shown by itself in diagrammatic FIGS. 4–6.

The tool or device 130 comprises a first elongate, generally rectilinear carriage member 132, preferably formed from a suitable rigid material, such as steel, shaped to define upstanding flange 134 at its rear end 136, and at its forward end 138 a pair of side tabs 140 and 142 that are in spaced apart coplanar relation, and are disposed below the level of the main body portion 144 of the member 132.

The tabs 140 and 142 are, as indicated, in coplanar relation, and are spaced below the level of the centrally located tab 146 sufficiently to closely receive the bridge base plate flange 108 from the rear edge 145 thereof, with the tabs 140 and 142 disposed on either side of the shank 112 of the fine tune screw 110 to which the tool or device 130 is applied, in the manner hereinafter described.

The tool or device elongate member 132 is in the nature of a carriage element and is formed to define an elongate rectilinear central slot 150 along the mid portion of same in which rides the tool slide or follower member 152 that is also formed of a suitable rigid material, such as steel, and is formed to define an upstanding flange 154 that is aligned with flange 134, a body portion 156 that depends from the flange 154 and extends through slot 150 and is angled forwardly of the carriage member 132 and terminates in a depending forward tab 158 that is notched as at 160 to receive the shank 100 of a clamp screw 102 in close fitting relation thereto, adjacent the head 104 of such screw 102.

Journaled in the flange 134 of carriage member 132 is threaded shank 162 that is threadedly received in threaded aperture 164 of the follower member flange 154, with a compression spring 168 being received over the shank 162 between the respective flanges 134 and 154. The threaded shank 162 is fixed to thumb knob or handle 170 that is suitably knurled as at 172 and it has a neck portion 174 that is biased against the rear side of flange 134 by the biasing action of spring 168, which is also provided to bias the follower member 152 away from the carriage member flange 134.

The tool or device 130 is employed in connection with each spring clamp and fine tuning assembly 70 to set the intonation of the string applied to the respective sets of apparatus 70, and as follows.

Assuming that the device or tool 130 is to be applied to the guitar lower E string, as shown in FIGS. 2 and 3, the device or tool 130 is installed by slipping the tabs 140, 142 and 146 at the forward end of the carriage member 132 onto the bridge plate flange 108 in alignment with the assembly 70 for the lower E string of the guitar. As indicated, the lower tabs 140 and 142 should be disposed on either side of the fine tuning screw 110 of that string 34, with the tab 146 being disposed closely adjacent or in substantial abutting relation with the shank 112 of the fine tuning screw 110 in question.

The threaded member 162 is adjusted forwardly (to the left of FIG. 3) as needed to dispose the follower member tab 158 over the shank 100 of the clamp screw 102 in question, with the threaded member 162 then being rotated to shift the follower member 154 rearwardly so as to seat the follower member flange 158 against the head 104 of the clamp screw 102 in question. This same rotational movement of the threaded member 162 is continued to firmly seat the follower member flange 150 against the underside of the head 104 of the clamp screw 102 in question, after which the clamp screw 80 of the assembly 70 being serviced is released so that the longitudinal tension of the string 34 is borne by the tool or device 130. Adjustment of the length of the string 34 in question is then made by rotating the threaded member 162, using the knurlled knob 170, either clockwise or counterclockwise, to move the slide member to the right or to the left of FIG. 3, to the proper position required for setting the intonation of string 34. Once the string 34 is adjusted to this intonation position, the clamp screw 80 is again retightened to fix the assembly 70 being serviced in the required intonation position, and the threaded member 162 is rotated to loosen the tool or device 130, as by shifting follower member 154 forwardly of the head 104 of the clamp screw 102 in question, as needed to relieve the tension applied to the tool or device 130. The tool or device 130 is then removed from the position indicated in FIGS. 2 and 3 and applied in a similar manner to the other bridge clamp and fine tuning assemblies 70 that need intonation type adjustment.

As should now be apparent, all of the assemblies 70 of the bridge arrangement 22 may be serviced in the manner indicated to set the intonation of the string applied to same, by using the tool or device 30 in the manner indicated. For the specific type of bridge arrangement 22 illustrated, it may be necessary to occasionally finger press the shank 100 of the clamping screw 102 being serviced against the action of its retaining leaf spring 118 in order to allow the tab 158 of the follower member 156 to disengage from the clamping screw 102 that has been serviced.

It will therefore be seen that the invention provides a tool or device which for the first time makes it possible to adjust the individual string clamping and fine tuning assemblies 70 to their proper position for setting the intonation of the string applied thereto, while at the same time maintaining adequate tension on the string as needed to compare and align the string first harmonic and the guitar twelfth fret, the latter being done in the usual manner by finger pressing of the string in question against the twelfth fret.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a device for tuning a stringed musical instrument, wherein each string of the instrument makes a first critical contact with the instrument at a point on the instrument nut and a second critical contact at a point on the instrument bridge, in which the instrument includes for each string thereof, discrete from the other strings thereof, a separate string support mounted on the instrument bridge including a first forward body releasably clamped to the bridge against movement toward in the direction toward the nut under tension in the string, a second rear body rearward of and aligned with and pivotally connected to the forward body for swinging movement about a pivot axis extending normally of the bias acting on the first body due to the tension in the spring, with the second body including a string contact surfacing that includes said second critical contact point and an abutment surface rearwardly of said second critical contact point against which the string is clamped, with the second body including a wall shaped rearward of its said abutment surface, a block located between said second body abutment surface and said second body abutment surface and said second body wall, and a first screw member including a shank threaded in said second body wall and abutting said block for clamping the string against said abutment surface and a head rearwardly of said second body for rotating said first screw member to clamp or release the string relative to said abutment surface, and with the bridge being equipped with a flange overlying said shank of said first screw member and a second screw member having a shank engaging the shank of said first screw member pivoting said second body relative to said first body for fine tuning of the string, a tool for setting the intonation of the string comprising:

a first elongate rigid member having one end formed for seating against the bridge flange in substantially parallel relation to the shank of the first screw, a second member mounted for shifting movement longitudinally of said first tool member and including a flange portion adapted to seat against the head of the first screw member, and means for feeding said tool second member longitudinally of said tool first member to, when the bridge first forward body is released whereby the string tension is applied to said tool, shift said bodies to set the intonation of the string.

2. The tool set forth in claim 1 wherein:

threaded means comprises the means for feeding said tool second member longitudinally of said tool first member including a knob for actuating said threaded means.

3. The tool set forth in claim 2 wherein:

said knob of said threaded means is located rearwardly of said tool first member.

4. The tool set forth in claim 3 including:

spring means for biasing said tool second member toward said one end of said tool first member.

5. The tool set forth in claim 4 wherein:

said tool first member one end is formed to be received on either side of said bridge flange portion in seating thereagainst.

6. The tool set forth in claim 5 wherein:

said tool first member is formed with a longitudinally extending aperture in which said tool second member rides.

7. The tool set forth in claim 6 wherein:

said threaded means comprises a threaded shank made fast to said knob and being journalled in the rear end of said tool first member and threadedly engaging said tool second member, said threaded shank substantially paralleling said tool second member.

8. The tool set forth in claim 7 wherein:

said flange portion of said tool second member defines a U-shaped slot for receiving the shank of the first screw members.

* * * * *